US006696670B1

(12) United States Patent
O'Donnell

(10) Patent No.: US 6,696,670 B1
(45) Date of Patent: Feb. 24, 2004

(54) GLOW PLUG WITH TIGHTLY-FIT ELECTRODE

(76) Inventor: Steven B. O'Donnell, 11435 Eberle Cir., Cerritos, CA (US) 90703

( * ) Notice: Subject to any disclaimer, the term of this patent is extended or adjusted under 35 U.S.C. 154(b) by 0 days.

(21) Appl. No.: 10/309,607

(22) Filed: Dec. 3, 2002

(51) Int. Cl.[7] ..... F23Q 7/00
(52) U.S. Cl. ..... 219/270; 219/541; 123/145 A
(58) Field of Search ..... 219/270, 541, 219/267, 544; 123/145 A, 145 R

(56) References Cited

U.S. PATENT DOCUMENTS 1,950,457 A * 3/1934 Payne et al. ..... 123/145 A
2,130,365 A * 9/1938 Paulson ..... 123/145 A
2,672,546 A * 3/1954 Klingner et al. ..... 123/145 A
2,884,920 A * 5/1959 Moule et al. ..... 123/145 A
3,017,541 A * 1/1962 Lawser ..... 123/145 A
3,749,980 A * 7/1973 Baxter ..... 219/267
4,088,105 A * 5/1978 Bhat et al. ..... 123/145 A
6,346,688 B1 2/2002 O'Donnell ..... 219/270
2002/0195436 A1 * 12/2002 Kumada et al. ..... 219/270

* cited by examiner

*Primary Examiner*—John A. Jeffery
(74) *Attorney, Agent, or Firm*—Edgar W. Averill, Jr.

(57) ABSTRACT

A glow plug has an outer body with an inner cavity having tapered, sidewalls. An insulating ring having outer tapered walls is held within the body and has an inner opening also having tapered walls. A central electrode, having a tapered wall section, fits tightly in the inner opening of the insulating ring. The insulating ring and central electrode are forced under pressure in the cavity of the glow plug to provide a glow plug capable of withstanding high temperature and pressure applications without leaking.

9 Claims, 2 Drawing Sheets

GLOW PLUG WITH TIGHTLY-FIT ELECTRODE

BACKGROUND OF THE INVENTION

The field of the invention is glow plugs and the invention relates more particularly to a high performance glow plug for use in state of the art engines, particularly in model car engines.

Internal combustion model cars have been refined to an extent that tethered model cars can substantially exceed 200 mph. In such extreme environments the glow plugs are heated to a temperature where conventional glow plugs will leak and fail. Various improvements in glow plug construction have been made. One such improvement is shown in U.S. Pat. No. 6,346,688 having the same applicant as the present application. This patent is incorporated by reference herein.

Temperatures at the lower end of a glow plug can reach in excess of 1000° F. The combination of the pressure in the cylinder of the engine and the high temperature of the lower end of the glow plug can result in the formation of leaks which reduce the compression within the cylinder which is highly detrimental to the performance of the engine. Various attempts at improving the crimping at the top of the glow plug have reduced, but not eliminated, the problem.

BRIEF SUMMARY OF THE INVENTION

It is an object of the present invention to provide a glow plug which can withstand state of the art high performance temperatures and pressures without leaking.

The present invention is for a glow plug having a body which can be affixed to an engine block and has an outer shell surrounding an inner cavity. The inner cavity of the body has a frusto-conical sidewall portion extending upwardly to a pressure-applying portion of the body. An inner electrode is held by the body and has a connector which is attached to a source of electrical energy. The inner electrode has a washer extending radially outwardly within the inner cavity of the glow plug body. The inner electrode has a frusto-conical wall length extending outwardly on the electrode below the washer. A pressure-applying element is held by the body above the washer and this may be a crimping backup washer against which the body of the glow plug is crimped to hold the assembly together. An insulating ring is held in the inner cavity of the body. The insulating ring has an outer frusto-conical length which meets with the inner cavity of the body, and an inner frusto-conical length which mates with the frusto-conical wall length of the electrode. After the assembly has been assembled under pressure, heat and gas are prevented from leaking through the glow plug by the contact between the four frusto-conical surfaces.

DETAILED DESCRIPTION OF THE INVENTION

Figure 1:
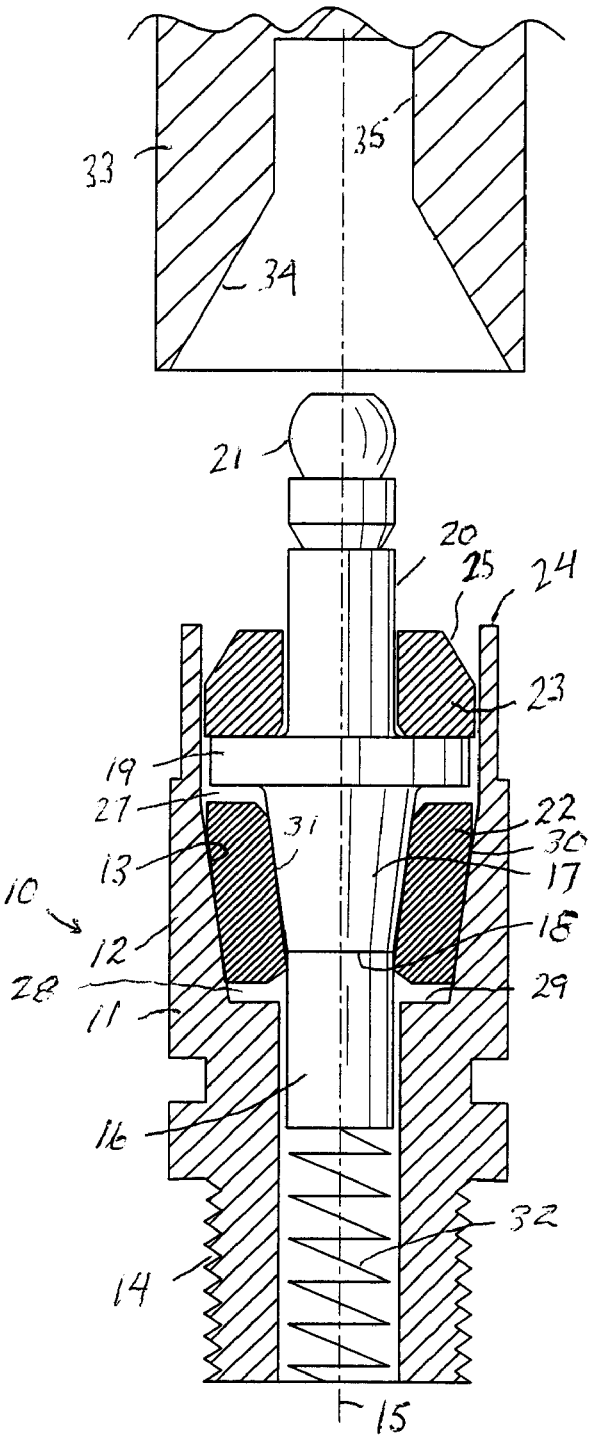
FIG. 1 is a cross-sectional view of the glow plug of the present invention prior to being crimped together.

A glow plug assembly prior to crimping is shown in FIG. 1 and indicated generally by reference character 10. Glow plug 10 has a body 11 which has an outer shell portion 12, which surrounds an inner cavity 13. The base of body 11 has a threaded portion 14, which would be screwed into an engine block in a conventional manner. Body 11 has a central axis 15 along which an inner electrode 16 is positioned.

Inner electrode 16 has a frusto-conical wall length 17, which extends upwardly from a base 18 to a washer 19. Washer 19 extends outwardly with respect to connector shaft 20. Washer 19 is preferably integrally formed with inner electrode 16.

Connector shaft 20 terminates in a connector for attachment to a source of electrical energy.

Figure 2:
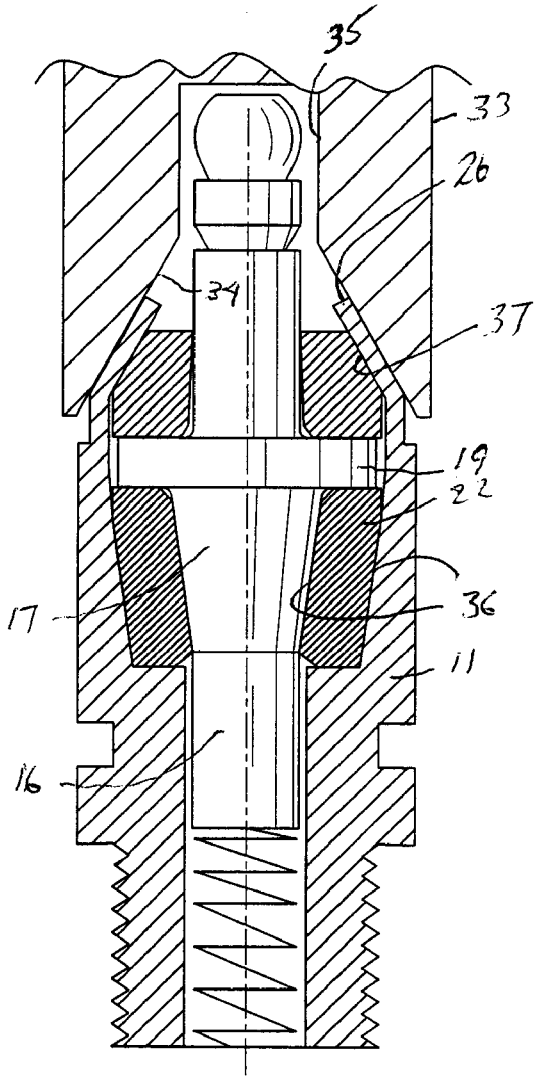
FIG. 2 is a cross-sectional view of the glow plug of the present invention after crimping.
Figure 3:
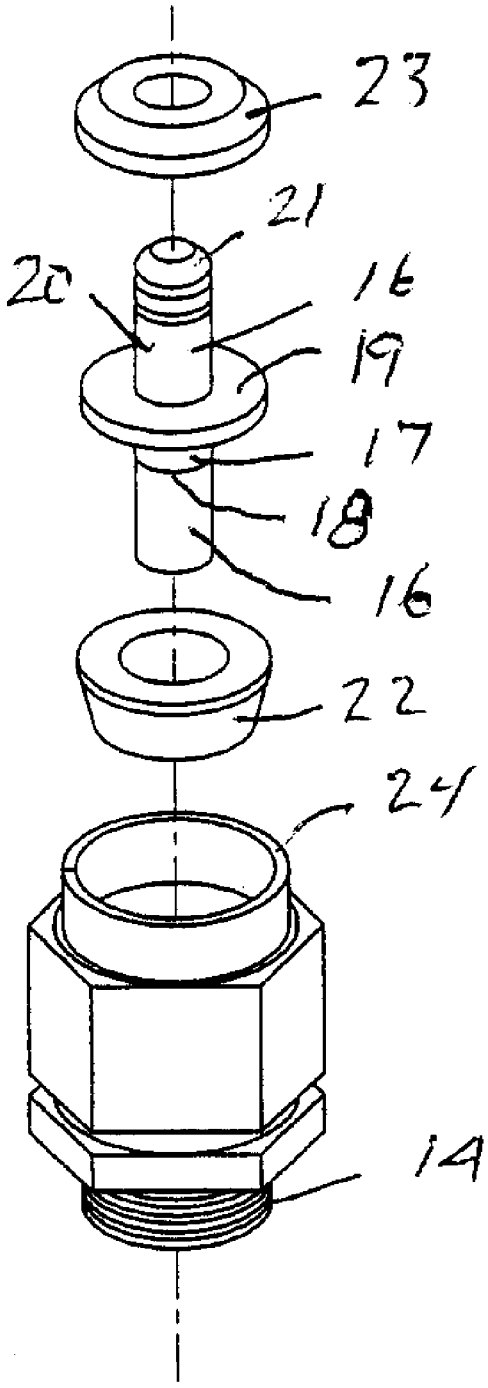
FIG. 3 is an exploded perspective view of the glow plug of FIG. 1.

Inner electrode 16 is held centrally in body 11 by a pair of insulated rings. Insulating ring 22 is fabricated from an electrically non-conductive material. One such material is hard anodized aluminum. All surfaces of ring 22 are anodized so that it does not conduct any electricity between inner electrode 16 and body 11. Similarly, an upper washer 23 is electrically non-conductive. It may also be made from hard anodized aluminum. Washer 23 is part of a pressure-applying portion of the assembly of FIG. 1. As shown in FIG. 2, upper ring 24 may be crimped against a frusto-conical portion 25, which is at an angle of, for instance, 30° with respect to central axis 15. The result is a continuous downward pressure formed by the contact between the crimped upper ring 26 and the frusto-conical portion 25 of upper washer 23.

As shown in FIG. 1, on initial assembly there is an upper gap 27 and a lower gap 28 between insulating ring 22 and washer 19 and lower floor 29, respectively. These gaps disappear during the crimping step as shown in FIG. 2. Preferably, castor oil is applied between the outer frusto-conical surface 30 and the inner cavity 13, as well as between the inner frusto-conical surface 31 of ring 22 and the frusto-conical wall length 17. Also, a light oil, such as that sold under the trademark "W-D 40," is preferably applied to the outer surface of upper washer 23 to help lubricate the downward compression movement of the parts to provide a glow plug such as that shown in FIG. 2. The glow plug in FIG. 2 has no gaps between the upper and lower surfaces of ring 22.

The heating element 32 is welded between the base of inner electrode 16 and body 11. The outer body is preferably fabricated from steel and the upper ring thereof 24 is moved inwardly by a crimping tool 33, which has a frusto-conical wall portion 34, and a connector opening 35. A downward pressure of 2500 to about 3000 pounds is preferably exerted, as shown in FIG. 2, which squeezes the inner electrode and the insulating ring downwardly until there is no significant gap above and below insulating ring 22, as shown in FIG. 2.

The frusto-conical angles relating to insulating ring 22 should be small enough so that they provide a locking taper. That is, when pressure is exerted downwardly on ring 22 in cavity 13, the angle is small enough so that the ring is locked into the cavity rather than simply falling out. This angle should be between 6° and 12°, and preferably about 8°. The presence of lubricant 36 and 37 helps to facilitate the elimination of gaps 27 and 28 during the crimping step. Also, it is believed that the use of castor oil at the area indicated by reference character 36 is further beneficial to prevent the escape of gases between ring 22 and either the body or the inner electrode. Castor oil, when sufficiently heated, will form a gummy residue which is believed to further enhance the sealing effect of the assembly under high temperatures.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A glow plug comprising:

a body having means for affixing the glow plug to an engine block, said body having an outer shell surrounding an inner cavity with a frusto-conical side wall portion extending upwardly to a pressure applying portion of said body;

an inner electrode held by said body, said inner electrode having a connector for attachment to a source of electrical energy, said electrode having a washer extending radially outwardly from said inner electrode within said inner cavity of said body and said inner electrode having a frusto-conical wall length extending outwardly on said electrode below said washer; said inner electrode having a heating element portion at a base thereof;

a pressure applying element held by said body above said washer of said inner electrode, said pressure applying element having means for applying a downward force on said inner electrode with respect to said body; and an insulating ring having a central axis and an outer frusto-conical length having an angle with respect to its central axis equal to an angle of said frusto-conical side wall portion of said inner cavity of said body and having an inner opening having a frusto-conical inner surface length having an angle with respect to its axis equal to an angle of said frusto-conical wall length of said inner electrode, said insulating ring being non-conductive to electricity.

2. The glow plug of claim 1 wherein said insulating ring is fabricated from anodized aluminum.

3. The glow plug of claim 1 wherein all frusto conical portions of said glow plug are between six and twelve degrees with respect to a central axis of said glow plug.

4. The glow plug of claim 3 wherein said frusto conical portions are eight degrees with respect to a central axis of said glow plug.

5. The glow plug of claim 1 wherein said pressure applying element is a crimped end of said body crimped against a back-up washer held above said washer extending radially outwardly from said inner electrode.

6. The glow plug of claim 5 wherein said back-up washer has a frusto-conical portion against which the body is crimped.

7. The glow plug of claim 1 wherein said washer extending radially outwardly from said inner electrode is formed integrally with said inner electrode.

8. The glow plug of claim 1 wherein said insulating ring has a flat top surface area and a flat bottom surface area and said flat top surface area abuts an underside of said washer extending radially outwardly from said inner electrode and the flat bottom surface contacts a floor of said inner cavity of said outer shell.

9. A process for fabricating a glow plug comprising:

inserting a bottom portion of a inner electrode into an opening of an insulating ring, said inner electrode having a bottom cylindrical portion extending upwardly to a frusto-conical length which terminates at an integral washer extending radially outwardly from said inner electrode and an upper connector portion extending upwardly from said washer, said insulating ring having an inner surface which mates with the frusto-conical length of said inner electrode and said insulating ring having an outer frusto conical outer surface;

inserting the inner electrode and insulating ring into an inner cavity in a glow plug outer shell, said inner cavity having a frusto conical inwardly facing wall which mates with the outer frusto conical outer surface of said insulating ring;

placing a crimp back-up washer over said upper connector portion against said washer; and crimping a pressure applying portion of said body against said crimp back-up washer to permanently assemble said inner electrode in said glow plug outer shell.

* * * * *